US011615937B2

(12) United States Patent
Ochi et al.

(10) Patent No.: US 11,615,937 B2
(45) Date of Patent: Mar. 28, 2023

(54) EMITTER SUPPORT STRUCTURE AND FIELD EMISSION DEVICE

(71) Applicant: MEIDENSHA CORPORATION, Tokyo (JP)

(72) Inventors: Hayato Ochi, Numazu (JP); Rena Takahashi, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 17/761,295

(22) PCT Filed: May 12, 2020

(86) PCT No.: PCT/JP2020/018913
§ 371 (c)(1),
(2) Date: Mar. 17, 2022

(87) PCT Pub. No.: WO2021/053876
PCT Pub. Date: Mar. 25, 2021

(65) Prior Publication Data

US 2022/0351930 A1 Nov. 3, 2022

(30) Foreign Application Priority Data

Sep. 19, 2019 (JP) ..... JP2019-169936

(51) Int. Cl.
*H01J 35/06* (2006.01)

(52) U.S. Cl.
CPC ..... *H01J 35/065* (2013.01)

(58) Field of Classification Search
CPC ..... H01J 35/065
See application file for complete search history.

(56) References Cited

U.S. PATENT DOCUMENTS 6,351,520 B1 * 2/2002 Inazaru ..... H01J 35/165 378/138
2013/0087813 A1 4/2013 Yan et al.
(Continued)

FOREIGN PATENT DOCUMENTS

CN 1501490 A 6/2004
CN 103079337 A 5/2013
(Continued)

OTHER PUBLICATIONS

Chinese Office Action, Application No. 202080065684.7, dated Jul. 4, 2022 with translation (15 pgs).
(Continued)

*Primary Examiner* — Chih-Cheng Kao
(74) *Attorney, Agent, or Firm* — Foley & Lardner LLP

(57) ABSTRACT

An emitter support structure for a field emission device, the emitter support structure includes: a support portion disposed to be moved in a direction of both ends of a vacuum chamber of the field emission device, and configured to support an emitter of the field emission device; a protruding portion formed at one end portion of the support portion which confronts a target of the field emission device, and to which the emitter is inserted and mounted; a slit formed in a circumference wall portion of the protruding portion in a height direction of the circumference wall portion; and a redundant brazing material groove formed in an outside of the protruding portion along the circumference wall portion.

5 Claims, 12 Drawing Sheets

(56) References Cited

U.S. PATENT DOCUMENTS

| | | | |
|---|---|---|---|
| 2016/0293561 | A1 | 10/2016 | Kadoguchi et al. |
| 2017/0365439 | A1 | 12/2017 | Takahashi et al. |
| 2019/0214215 | A1 | 7/2019 | Takahashi et al. |

FOREIGN PATENT DOCUMENTS

| | | | |
|---|---|---|---|
| CN | 107112179 | A | 8/2017 |
| JP | 2005-74472 | A | 3/2005 |
| JP | 2012-191021 | A | 10/2012 |
| JP | 6135827 | B2 | 5/2017 |
| KR | 10-2016-0075649 | | 6/2016 |
| KR | 10-2019-0008981 | | 1/2019 |

OTHER PUBLICATIONS

Korean Office Action, Application No. 10-2022-7008994, dated Aug. 18, 2022 with translation (8 pgs).

* cited by examiner

EMITTER SUPPORT STRUCTURE AND FIELD EMISSION DEVICE

TECHNICAL FIELD

This invention relates to an emitter support structure and a field emission device which are applied to various devices such as an X ray device, an electron tube, and a lightening device.

BACKGROUND ART

A field emission device is applied to various devices such as an X ray device, an electron tube, and a lightening device. The field emission device is configured to emit an electron beam by a field emission of an emitter (the electron is generated and emitted) by applying the voltage between the emitter (an electric source such as carbon), and a target which are positioned in a direction to confront each other within a vacuum chamber of a vacuum vessel (positions with a predetermined distance) (patent document 1). This electron beam is collided on the target, so to attain a desired function (for example, a radioscopic resolution function due to external X ray radiation in the case of X ray device).

PRIOR ART DOCUMENT

Patent Document

Patent Document 1: Japanese Patent No. 6135827

SUMMARY OF THE INVENTION

In the conventional field emission device, in a state in which the electron generating portion and the guard electrode are apart from each other by the operation of the emitter support portion, the voltage is applied to the guard electrode. With this, the reforming treatment is performed on at least the guard electrode within the vacuum chamber, so as to obtain a desired withstand voltage in the field emission device.

The field emission device is formed by the vacuum brazing. When the variations of the various conditions such as the brazing material amount, the surface condition of the support member, and the state of the vacuum furnace are overlapped (simultaneously generated), the redundant brazing material may be leaked and expanded. In this case, this problem is not considered in the field emission device. Accordingly, the leaked and expanded redundant brazing material reaches an outer circumference portion of the support member, and is jointed with the guard electrode. With this, it is not possible to push the emitter from a discharge position to a non-discharge position, so that the function of the field emission device is lost. Moreover, a clearance between contact surfaces of the support member and the emitter is small. The gas such as the air is not completely drained so that the gas such as the air is remained. With this, the junction defect and so on may be generated.

It is, therefore, an object of the present invention to dissolve the above-described problems, and to avoid a joint of redundant brazing material and a guard electrode in a vacuum brazing process of a field emission device.

In one aspect according to the present invention, an emitter support structure for a field emission device, the emitter support structure comprises: a support portion disposed to be moved in a direction of both ends of a vacuum chamber of the field emission device, and configured to support an emitter of the field emission device; a protruding portion formed at one end portion of the support portion which confronts a target of the field emission device, and to which the emitter is inserted and mounted; a slit formed in a circumference wall portion of the protruding portion in a height direction of the circumference wall portion; and a redundant brazing material groove formed in an outside of the protruding portion along the circumference wall portion.

In one aspect according to the present invention, in the emitter support structure, the slit is formed to have a depth identical to a height of the circumference wall portion.

In one aspect according to the present invention, in the emitter support structure, a plurality of the slits are formed in radial directions of the circumference wall portion.

In one aspect according to the present invention, in the emitter support structure, a gas release groove is formed in an emitter disposition portion of the support portion along the radial direction of the protruding portion; the gas release groove is connected to the redundant brazing material release groove; and the gas release groove has a depth smaller than a depth of the redundant brazing material releasing groove.

In one aspect according to the present invention, in the emitter support structure, field emission device comprises: a vacuum vessel which includes a vacuum chamber, and which is formed of a cylindrical insulator; an emitter which is located on one end side of the vacuum chamber, and which includes an electron generating portion confronting the other end side of the vacuum chamber; a guard electrode disposed on an outer circumferential side of the electron generating portion of the emitter; a target which is located on the other end side of the vacuum chamber, and which confronts the electron generating portion of the emitter; and a supporting portion disposed to be moved in a direction of both ends of the vacuum chamber, and configured to support the emitter; a protruding portion formed at one end portion of the support portion which confronts the target, and to which the emitter is inserted and mounted; a slit formed in a circumference wall portion of the protruding portion in a height direction of the circumference wall portion; and a redundant brazing material groove formed in an outside of the protruding portion along the circumference wall portion.

In this present invention, it is possible to avoid the joint between the redundant brazing material and the guard electrode in the process of the vacuum brazing process.

DESCRIPTION OF EMBODIMENTS

Hereinafter, embodiments according to the present invention are explained with reference to the drawings.

First Embodiment

Figure 1:
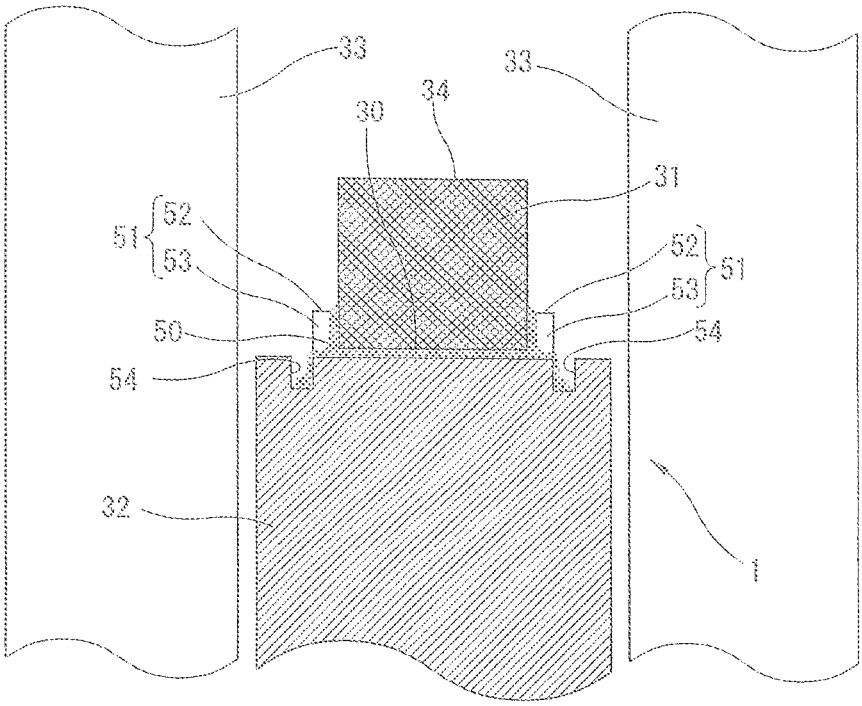
FIG. 1 is an enlarged sectional view showing an emitter support structure of a field emission device according to a first embodiment of the present invention.
Figure 7:
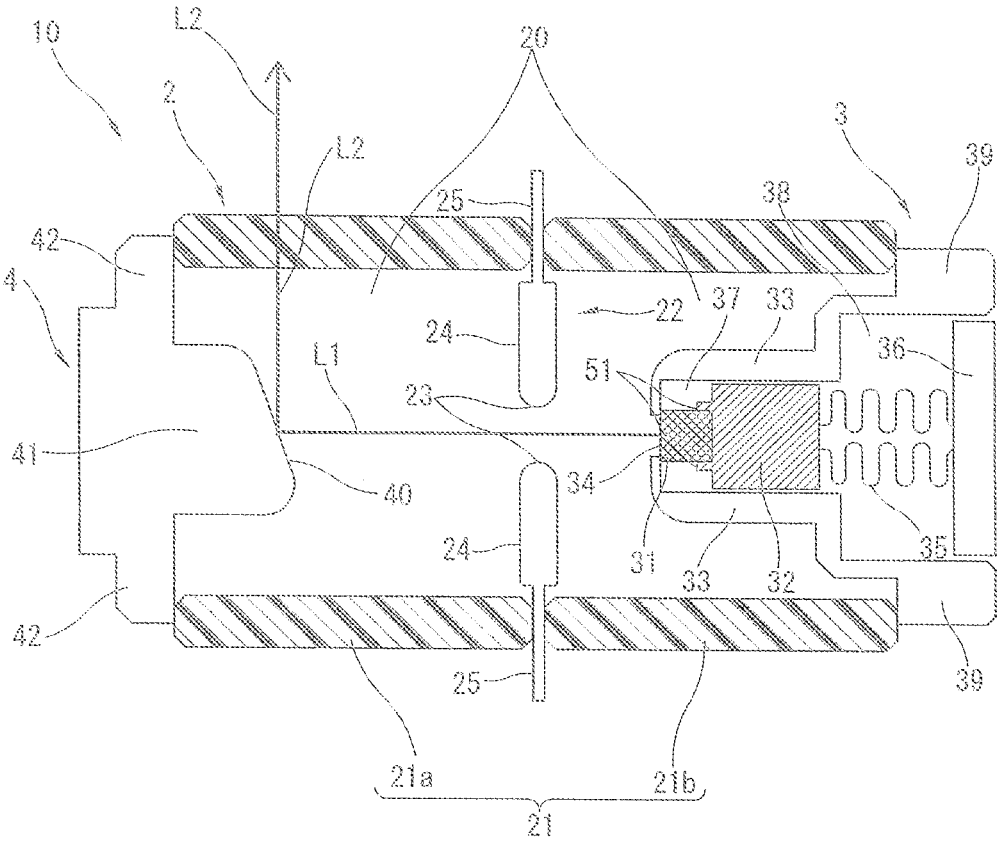
FIG. 7 is a schematic sectional view showing one example of the field emission device.

An emitter support structure 1 shown in FIG. 1 according to a first embodiment of the present invention is applied to, for example, a field emission device 10 shown in FIG. 7. The field emission device 10 includes a vacuum vessel 2; an emitter unit 3; and a target unit 4.

(Vacuum Vessel)

The vacuum vessel 2 is formed from a cylindrical insulator 21 including a vacuum chamber 20. The insulator 21 is made of insulating material such as ceramic. The insulator 21 can employ various forms as long as the insulator 21 insulates between the emitter unit 3 and the target unit 4, and includes the vacuum chamber 20. For example, in a state in which a grid electrode 22 is disposed between cylindrical insulating members 21*a* and 21*b* disposed in series with each other, these are assembled by the brazing and so on. The grid electrode 22 can employ various forms as long as the grid electrode 22 is disposed between the emitter unit 3 and the target unit 4, and configured to control an electron beam L1 passing through the grid electrode 22. For example, the grid electrode 22 includes an electrode portion 24 including a passage hole 23 which extends in a transverse direction of the vacuum chamber 1, and through which the electron beam L1 passes; and a lead terminal 25 which penetrates through the insulator 21, and which is connected to the electrode portion 24.

(Emitter Unit 3)

The emitter unit 3 includes an emitter 31; an emitter support portion 32; and a guard electrode 33. The emitter 31 includes an electron generating portion 34 confronting a target 41 of the target unit 4. The electron generating portion 34 is configured to generate the electron by being applied with the voltage, and to emit the electron beam L1. The emitter support portion 32 is disposed to be movable in a direction of the both ends of the vacuum chamber 20. The emitter support portion 32 supports the emitter 31 so that the electron generating portion 34 confronts the target 41. An operation portion 36 is connected through a bellows 35 to the emitter support portion 32. The operation portion 36 is configured to operate the emitter support portion 32 through the bellows 35. The guard electrode 33 is made of material such as stainless. The guard electrode 33 is disposed on the outer circumference side of the electron generating portion 34 of the emitter 31. The guard electrode 33 includes a first receiving portion 37; and a second receiving portion 38 connected with the first receiving portion 37. The first receiving portion 37 receives the emitter 31 and the emitter support portion 32. The second receiving portion 38 receives the bellows 35 and the operation portion 36. Moreover, the second receiving portion 38 is fixed though a flange portion 39 to an opening edge portion of the insulating member 21*b* of the vacuum vessel 2.

Furthermore, a cylindrical protruding portion 51 protrudes from one end portion of the emitter support portion 32 which confronts the target 41. The emitter 31 is inserted and mounted in the protruding portion 51.

Figure 2:
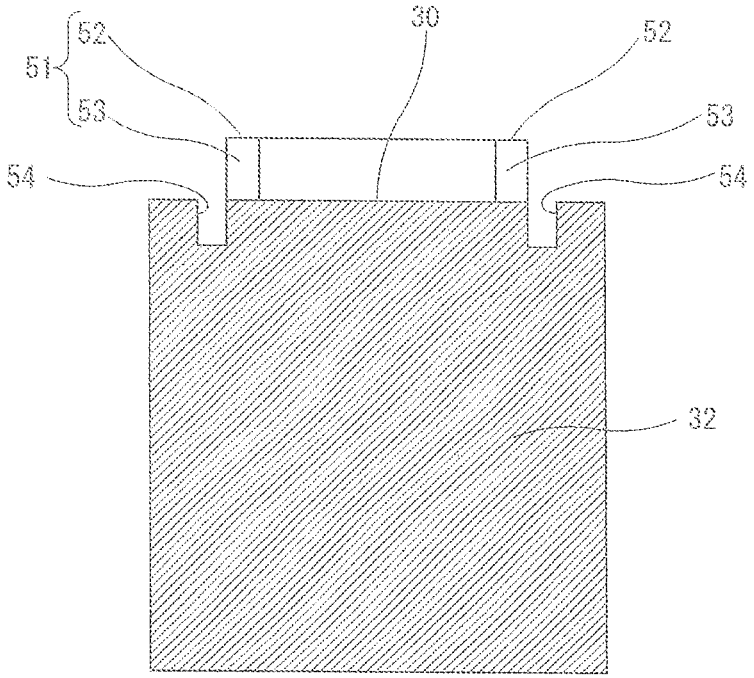
FIG. 2 is a schematic sectional view of an emitter support portion according to the first embodiment.

Moreover, in this one end portion of the emitter support portion 32, it is possible to avoid the joint between the redundant brazing material 50 and the guard electrode 33 in the vacuum brazing process of the field emission device 10. That is, as shown in FIG. 2, slits (cutting) 53 are formed in a circumference wall portion 52 of the protruding portion 51 in a height direction of the circumference wall portion 52.

Figure 3:
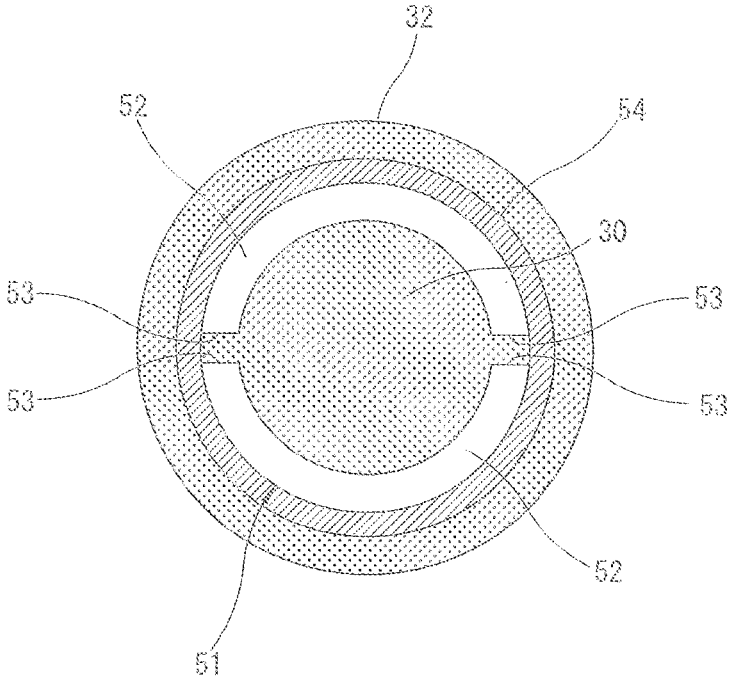
FIG. 3 is a schematic plan view of the emitter support portion of FIG. 2.

Each of the slits 53 is formed to have a depth identical to a height of the circumference wall portion 52. Furthermore, as shown in FIG. 3, a plurality of slits 53 are radially formed in the circumference wall portion 52. Moreover, a redundant brazing material release groove 54 is formed in the one end portion of the emitter support portion 32 along the circumference wall portion 52 of the protruding portion 51.

(Target Unit 4)

As shown in FIG. 7, the target unit 4 includes a target 41 and a flange portion 42. The target 41 is located on the other end side of the vacuum chamber 20. The target 41 confronts the electron generating portion 34 of the emitter 31. The flange portion 42 is fixed on an opening edge portion of the insulating member 21*a* of the vacuum vessel 2. The target 41 can employ various forms as long as the electron beam L1 emitted from the electron generating portion 34 of the emitter 31 is collided on the target 41, and the target 41 emits the X ray L2 and so on, as shown in the drawing. This target 41 includes an inclination surface 40 which is formed at a portion confronting the electron generating portion 34 of the emitter 31, and which extends in an intersecting direction inclined at a predetermined angle with respect to the electron beam L1. By the collision of the electron beam L1 with this inclination surface 40, the X ray L2 is radiated in a direction bent from the emission direction of the electron beam L1 (for example, in a cross-section surface direction of the vacuum chamber 20 as shown in the drawing).

(Operations and Effects of this Embodiment)

In the field emission device, in a state in which the electron generating portion 34 and the guard electrode 33 are apart from each other by the operation of the emitter support portion 32 by the operation portion 36, the voltage is applied to the guard electrode 33. With this, the reforming treatment can be performed to at least the guard electrode 33 within the vacuum chamber 20 (for example, the surface of the guard electrode 33 is melted and smoothened). Moreover, it is possible to obtain the desired withstand voltage in the field emission device 10.

Figure 8:
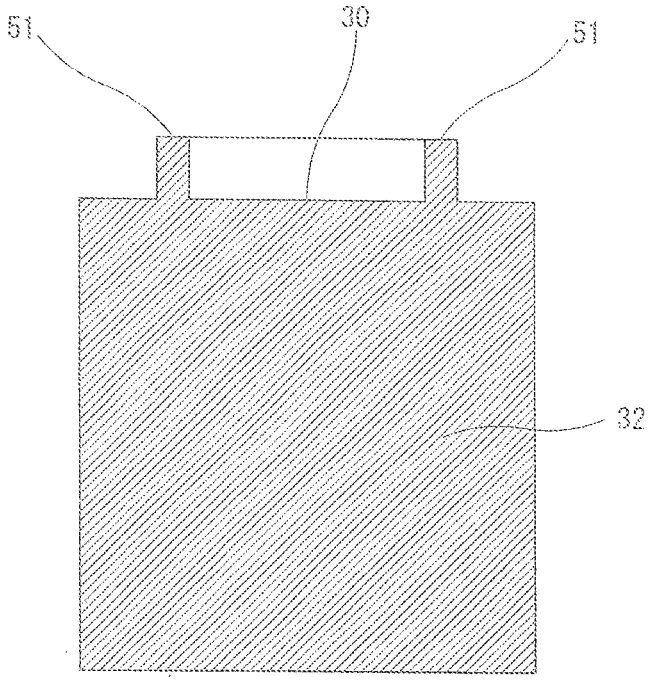
FIG. 8 is a schematic sectional view of a conventional emitter support portion.
Figure 9:
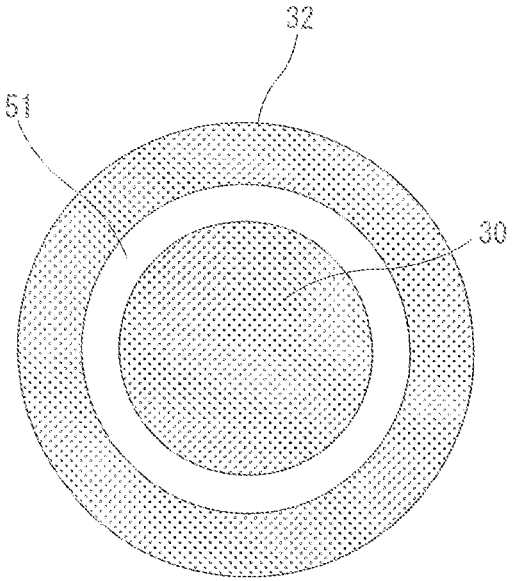
FIG. 9 is a schematic plan view of the emitter support portion of FIG. 8.
Figure 10:
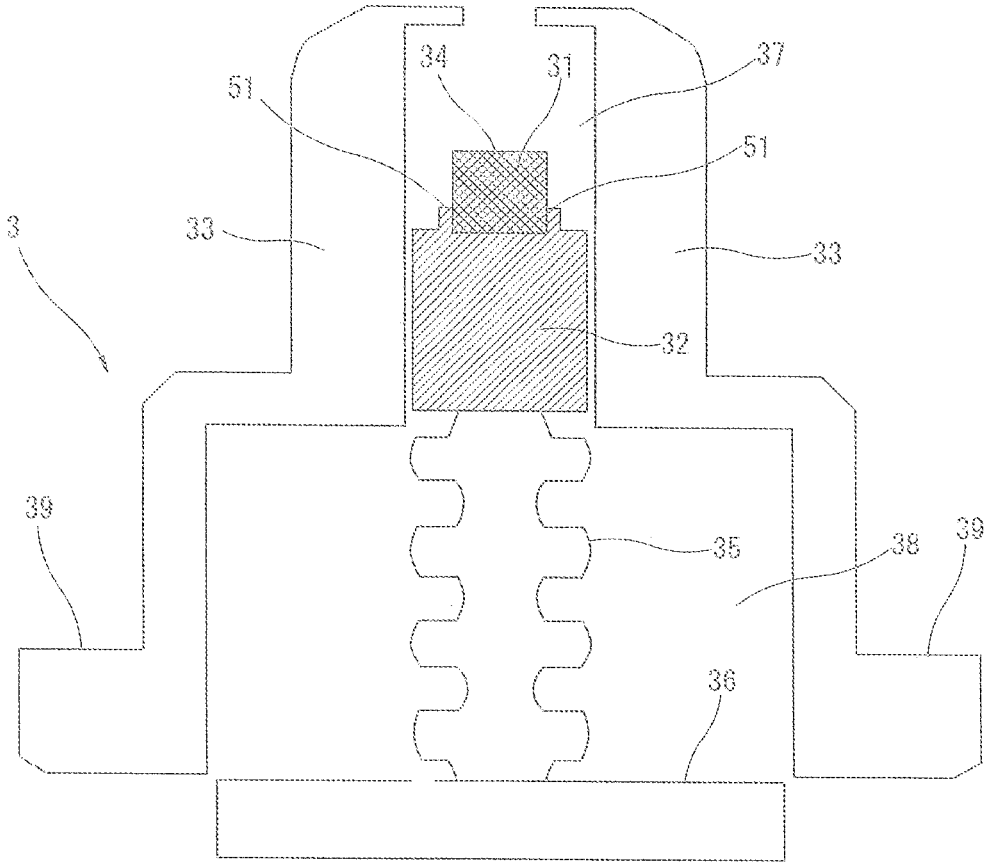
FIG. 10 is a schematic explanation view of the field emission device in a state in which an emitter is at a non-discharge portion.
Figure 11:
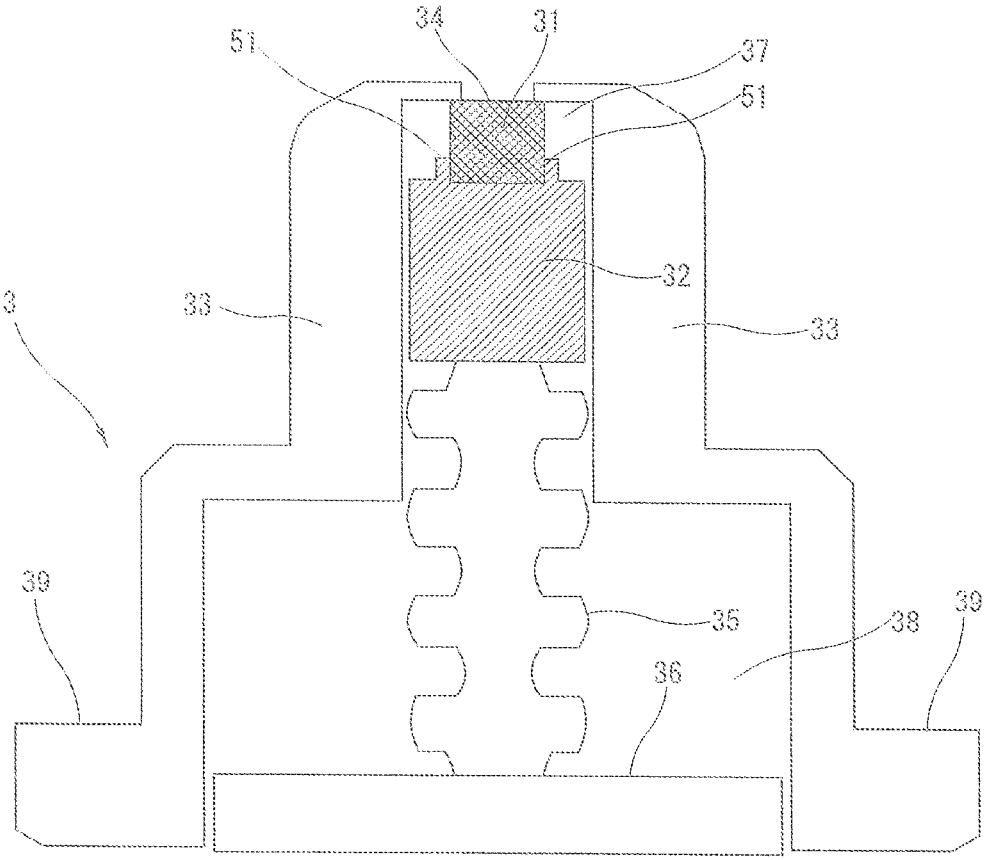
FIG. 11 is a schematic explanation view of the field emission device in a state in which the emitter is at a discharge portion.
Figure 12:
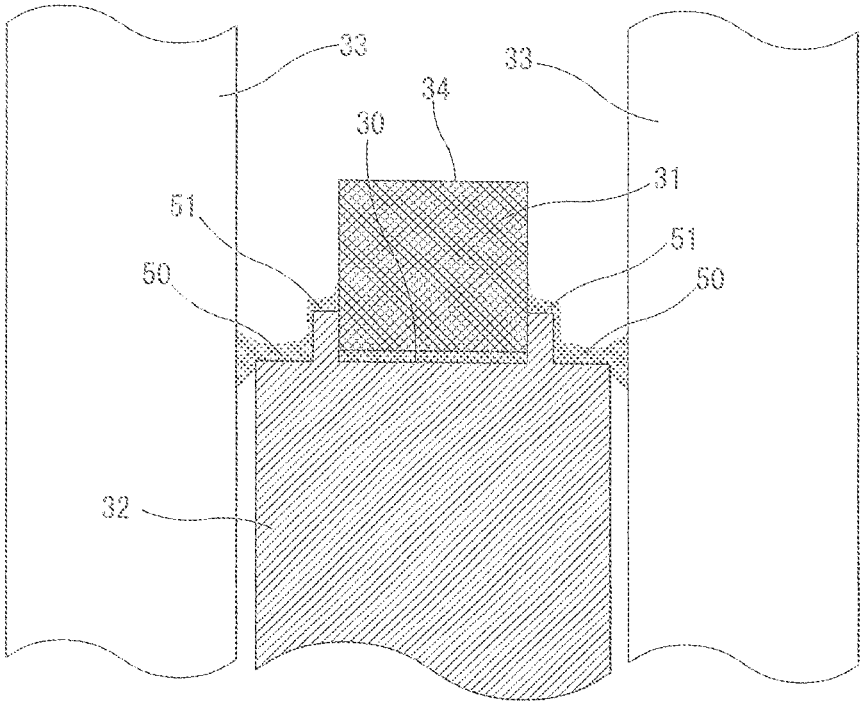
FIG. 12 is an enlarged sectional view of the conventional emitter support structure when the flow, influx of the redundant brazing material is generated.

In general, the field emission device is formed by the vacuum brazing. When the variations of the various conditions such as the brazing material amount, the surface condition of the support member of the emitter, and the state of the vacuum furnace are overlapped (simultaneously generated), the redundant brazing material may be leaked and expanded. The conventional emitter support structure exemplified in FIGS. 8 and 9 has a structure having only the protruding portion 51 in which the emitter 31 is inserted and mounted. Accordingly, the leaked and expanded redundant brazing material 50 reaches the outer circumference portion of the emitter support portion 32, as shown in FIG. 12. When the redundant brazing material 50 is jointed with the guard electrode 33, the emitter 31 cannot be shifted from the non-discharge position (FIG. 10) to the discharge position (FIG. 11), so that the function of the field emission device is lost (FIG. 12). Moreover, a clearance between the contact surfaces of the emitter support portion 32 and the emitter 31 is small. With this, the gas such as the air cannot be released to be remained so as to cause the junction defect and the unnecessary inclination of the emitter.

On the other hand, as shown in FIGS. 2 and 3, the emitter support portion 32 according to the embodiment includes the slits 53 formed in the circumference wall portion 52 of the protruding portion 51. Moreover, the redundant brazing material releasing groove 54 is formed adjacent to the protruding portion 51. Accordingly, the redundant brazing material 50 is shifted through the slits 53 to the redundant brazing material releasing groove 54 in the process of the vacuum brazing, as shown in FIG. 1.

Therefore, in the above-described emitter support structure 1 including the slits 53 and the redundant brazing material releasing groove 54, even when the redundant brazing material 50 is leaked to the outside of the protruding portion 51, it is possible to avoid the diffusion toward the outside of the emitter support portion 32, and the joint with the guard electrode 33 (FIG. 1). Consequently, it is possible to ensure the function of the field emission device 10 configured to arbitrarily set the distance between the target 41 and the electron generating portion 34 of the emitter 31. Moreover, the slits 53 are formed, so that the gas such as the air in the clearance between the contact surfaces of the emitter support portion 32 and the emitter 31 is discharged. Accordingly, it is possible to prevent the poor contact, and so on.

Furthermore, the slits 53 are formed to have the depth identical to the height of the circumference wall portion 52. Accordingly, it is possible to more effectively shift the redundant brazing material 50 from the slits 53 to the redundant brazing material releasing groove 54. Moreover, the plurality of the slits are formed. Therefore, it is possible to improve the effects of the discharge of the gas, and the shift of the redundant brazing material 50.

Second Embodiment

When the gas release (degas) between the emitter 31 and the emitter support portion 32 is insufficient in the vacuum brazing process, in a case in which the emitter 31 is disposed to be inclined with respect to the emitter support portion 32, the desired current value may not be obtained, and the emitted electron may not be converged (focused).

Figure 4:
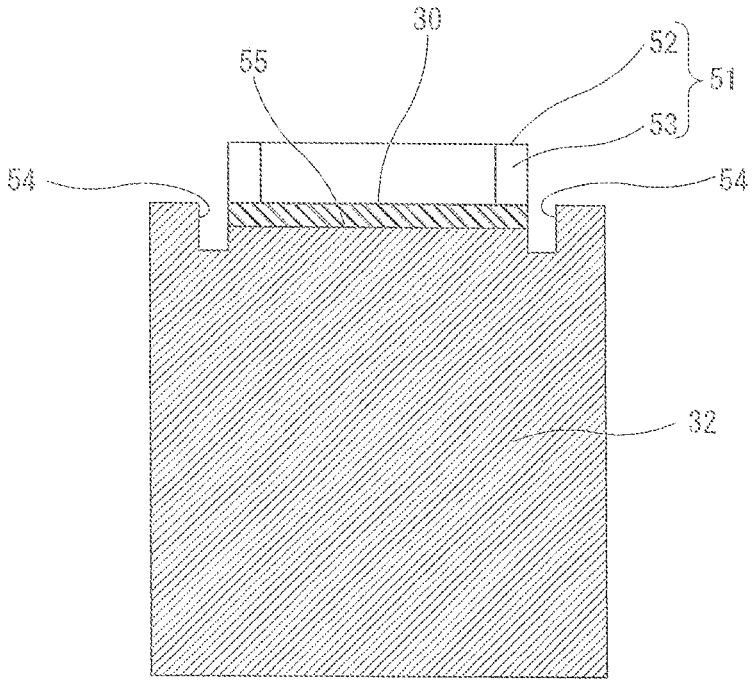
FIG. 4 is a schematic sectional view of an emitter support portion according to a second embodiment of the present invention.
Figure 5:
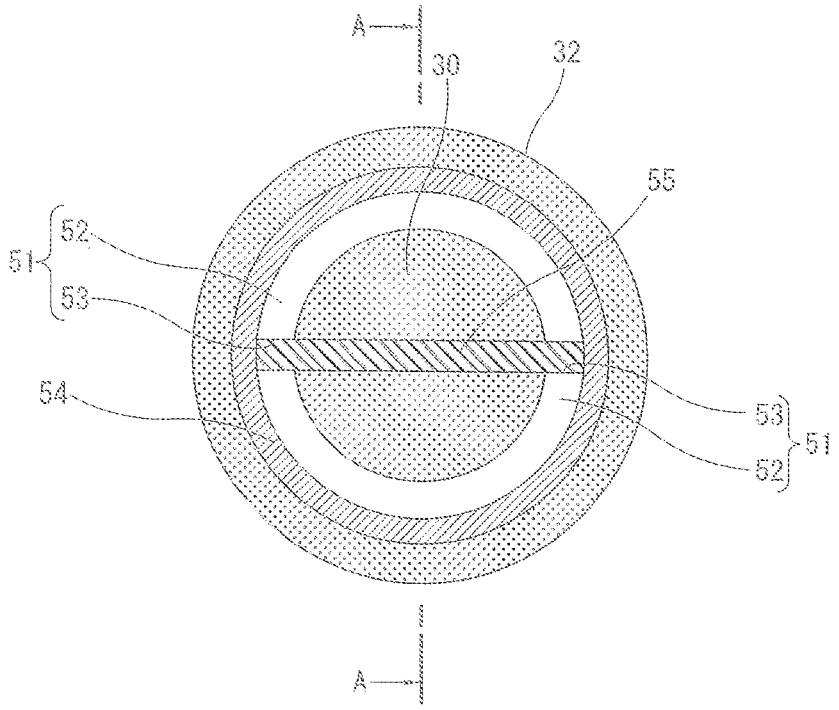
FIG. 5 is a schematic plan view of the emitter support portion of FIG. 4.
Figure 6:
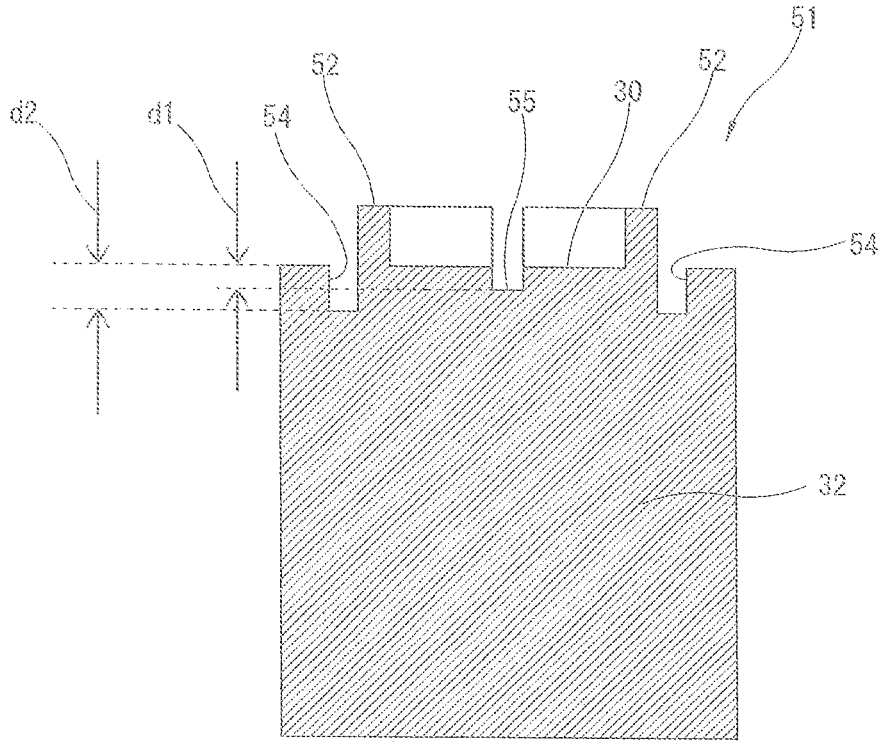
FIG. 6 is a sectional view taken along an A-A line of FIG. 5.

Accordingly, the emitter support structure 1 shown in FIGS. 4-6 according to the second embodiment is configured to prevent the expansion of the redundant brazing material 50 to the outer circumference of the emitter support portion 32, and thereby to prevent the inclination of the emitter 31. That is, in the emitter support structure 1 according to this embodiment, a gas release groove 55 is further formed in an emitter disposition portion 30 of the emitter support portion 32.

The gas release groove 55 is formed along the radial direction of the protruding portion 51. Moreover, the gas release groove 55 is connected with the redundant brazing material releasing groove 54. The gas release groove 55 has a depth d1 set to be smaller than a depth d2 of the redundant brazing material release groove 54.

As described above, the emitter disposition portion 30 includes the gas release groove 55. With this, the gas remained between the emitter support portion 32 and the emitter disposition portion 30 in the vacuum brazing process is shifted through the gas release groove 55 to the redundant brazing material release groove 54. Accordingly, in addition to the effects of the first embodiment, it is possible to improve the tight abutment between the emitter disposition portion 30 and the emitter 31, and to more effectively prevent the above-mentioned problems due to the inclination disposition of the emitter 31.

Moreover, in a case in which the brazing material used between the emitter disposition portion 30 and the emitter 31 employs a ring-shaped member having a hole for the emitter attachment formed in a disc, it is possible to further improve the tight abutment between the emitter disposition portion 30 and the emitter 31.

Furthermore, as shown in FIG. 6, the depth d1 of the gas release groove 55 is set to be smaller than the depth d2 of the redundant brazing material release groove 54. With this, it is possible to prevent the deficiency of the brazing material due to the forming of the gas release groove 55 in the emitter disposition portion 30.

EXPLANATION OF SYMBOLS

1 . . . emitter support structure
2 . . . vacuum vessel, 20 . . . vacuum chamber
3 . . . emitter unit, 30 . . . emitter disposition portion, 31 . . . emitter, 32 . . . emitter support portion, 33 . . . guard electrode
4 . . . target unit, 41 . . . target, 42 . . . flange portion
10 . . . field emission device
50 . . . redundant brazing material, 51 . . . protruding portion, 52 . . . circumference wall portion, 53 . . . slit, 54 . . . redundant brazing material release groove, 55 . . . gas release groove

The invention claimed is:

1. An emitter support structure for a field emission device, the emitter support structure comprising:
- a support portion disposed to be moved in a direction of both ends of a vacuum chamber of the field emission device, and configured to support an emitter of the field emission device;
- a protruding portion formed at one end portion of the support portion which confronts a target of the field emission device, and to which the emitter is inserted and mounted;
- a slit formed in a circumference wall portion of the protruding portion in a height direction of the circumference wall portion; and
- a redundant brazing material release groove formed in an outside of the protruding portion along the circumference wall portion.

2. The emitter support structure as claimed in claim 1, wherein the slit is formed to have a depth identical to a height of the circumference wall portion.

3. The emitter support structure as claimed in claim 1, wherein a plurality of the slits are formed in radial directions of the circumference wall portion.

4. The emitter support structure as claimed in claim 1, wherein a gas release groove is formed in an emitter disposition portion of the support portion along the radial direction of the protruding portion; the gas release groove is connected to the redundant brazing material release groove; and the gas release groove has a depth smaller than a depth of the redundant brazing material release groove.

5. A field emission device comprising:
- a vacuum vessel which includes a vacuum chamber, and which is formed of a cylindrical insulator;

an emitter which is located on one end side of the vacuum chamber, and which includes an electron generating portion confronting the other end side of the vacuum chamber;

a guard electrode disposed on an outer circumferential side of the electron generating portion of the emitter;

a target which is located on the other end side of the vacuum chamber, and which confronts the electron generating portion of the emitter; and a supporting portion disposed to be moved in a direction of both ends of the vacuum chamber, and configured to support the emitter;

a protruding portion formed at one end portion of the support portion which confronts the target, and to which the emitter is inserted and mounted;

a slit formed in a circumference wall portion of the protruding portion in a height direction of the circumference wall portion; and a redundant brazing material release groove formed in an outside of the protruding portion along the circumference wall portion.

* * * * *